United States Patent [19]

Bigi

[11] 4,057,407

[45] Nov. 8, 1977

[54] METHOD AND APPARATUS FOR RECOVERING ARGON FROM AN AIR FRACTIONATING PROCESS

[75] Inventor: Emanuele Bigi, Bergamo, Italy

[73] Assignee: S.I.A.D. Societa' Italiana Acetilene E Derivati, Bergamo, Italy

[21] Appl. No.: 669,420

[22] Filed: Mar. 22, 1976

[30] Foreign Application Priority Data

Mar. 26, 1975 Italy ..... 21663/75

[51] Int. Cl.[2] ..... F25J 3/04

[52] U.S. Cl. ..... 62/22; 62/30; 62/42

[58] Field of Search ..... 62/29, 30, 22, 42, 36

[56] References Cited

U.S. PATENT DOCUMENTS

| | | | |
|---|---|---|---|
| 2,530,602 | 11/1950 | Dennis | 62/22 |
| 2,700,282 | 1/1955 | Roberts | 62/22 |
| 3,037,359 | 6/1962 | Knapp | 62/22 |

*Primary Examiner*—Hiram H. Bernstein
*Attorney, Agent, or Firm*—Remy J. Van Ophem

[57] ABSTRACT

A method for the purification of argon in a gas obtained as a by-product from the fractionation of air to the recover $O_2$ and $N_2$ is described. The argon-containing gas is fed to a single argon-rectifying column which separates oxygen and then to a conventional purification column in which the separation takes place. The apparatus for carrying out the method comprises a rectification column having the top connected to a heating compressing and cooling circuit for liquefying and recycling in the liquid state the evolved vapors; the bottom of the column is heated by a fraction of the compressed but not cooled gaseous mixture drawn from the heating and compressing section of said circuit; the end section of this latter being further connected to a conventional nitrogen-withdrawing column for feeding a portion of the oxygen-free liquefied product.

8 Claims, 1 Drawing Figure

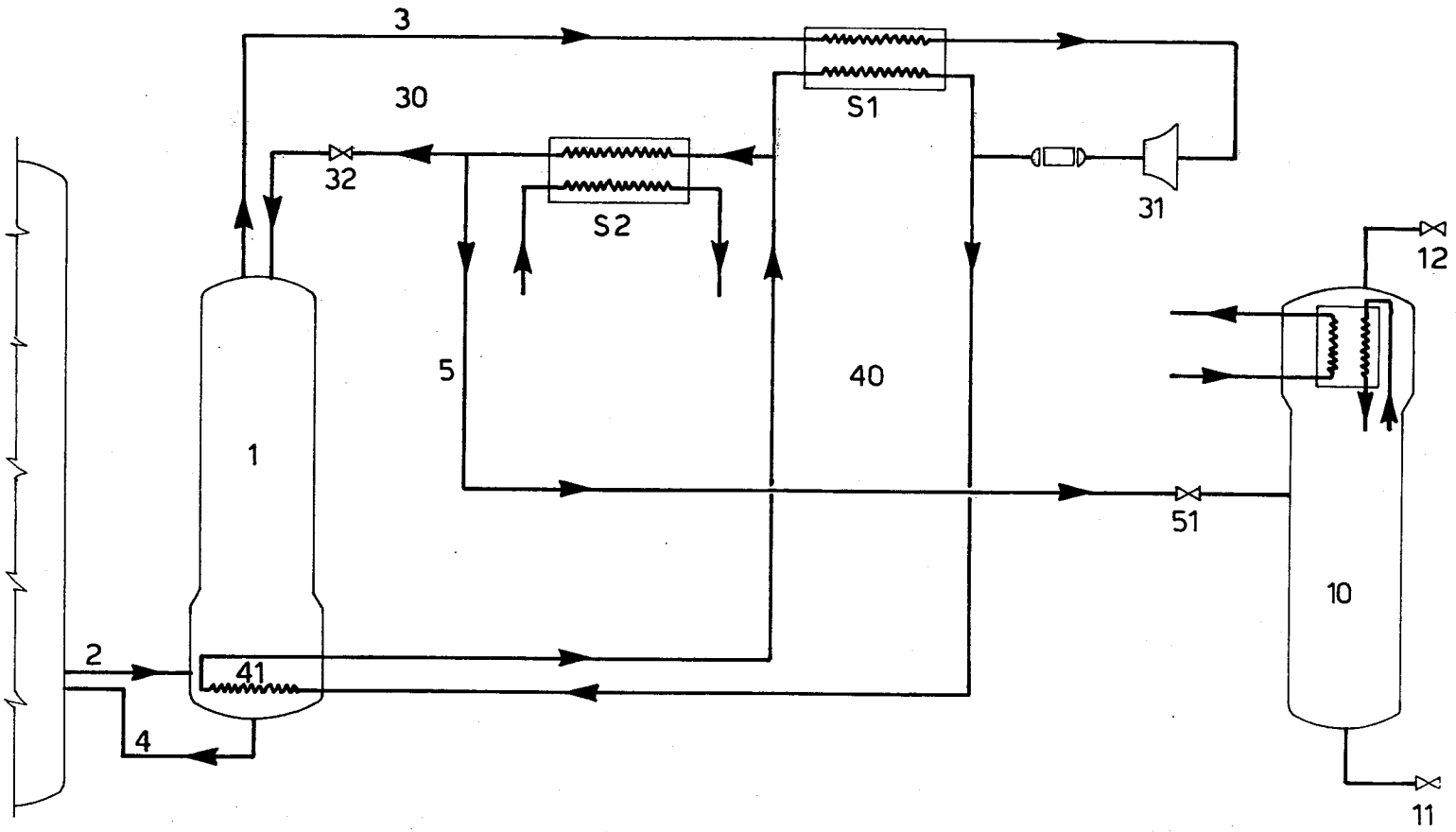
12
11
10
51
31
S1
40
S2
5
3
30
32
1
41
4
2

METHOD AND APPARATUS FOR RECOVERING ARGON FROM AN AIR FRACTIONATING PROCESS

BACKGROUND OF THE INVENTION

The present invention relates to a process for producing argon by separation from oxygen and nitrogen in an air fractionating process.

It is known that separation of argon from other atmospheric gases has so far been carried out by drawing gas from an air fractionating column at a height which is intermediate between the bottom and the top on a column zone which is known to correspond to the maximum enrichment of argon on the basis of theoretical considerations or practical measurements. In air fractionating plants with double rectification for producing oxygen and nitrogen, the drawing of gas for recovering argon is carried out from the upper or rectification column.

It is also known that the separation of gaseous argon is difficult, though it is the most usual rare gas of the atmosphere, due to the fact that its boiling temperature is near to the ones of oxygen and nitrogen and intermediate between both. Vapour drawn from the rectification column was hiterto forwarded to the top of an auxiliary operation column, called "argon column", in which the vapor was partially freed from its $O_2$ component and from which a product containing from 60 to 99% in volume of argon, from 0,3 to 20% of oxygen and again from 0,3 to 20% of nitrogen was released.

Consequently at the outlet of the argon column the product has to be again purified from oxygen and nitrogen and this is usually accomplished for $O_2$ by combining it with hydrogen on particular purifying agents, so that $O_2$ and $H_2$ combine mutually thus producing water.

Such process involves nevertheless some inconveniences such as the complexity of the operations to which the product must be subjected before obtaining argon substantially free from $O_2$.

It has to be chiefly taken into account the high cost of purifying agents, generally catalysts (for instance palladium based), and of reacting hydrogen and moreover the fact that the obtained product must be dried and freed from hydrogen and nitrogen in excess.

SUMMARY OF THE INVENTION

It has been now conceived and is the object of the present invention a method for producing argon by an air fractionating column which overcomes any of the above mentioned inconveniences thus allowing to obtain argon free from oxygen, by means of a single argon rectifying column starting as in the prior art from vapor drawn at an intermediate height of the rectifying column in the air fractionation process for producing oxygen and nitrogen. Argon, which is thus freed from oxygen, can be supplied to a conventional purification column for the separation from nitrogen and so obtained in a substantially pure state from the base thereof.

The method for producing argon according to the present invention is characterized in that it comprises the operations of forwarding to a fractionation column the product coming out from an intermediate point of a rectification column in an air fractionation plant; heating the gaseous product coming out from the head of said column; compressing it and then cooling a fraction thereof up to the liquefaction temperature of argon corresponding to the compression pressure; supplying again a portion of the thus liquefied argon to the head of said column through a throttling element in order to provide the refluxing liquid of said column, the other fraction of liquid argon being forwarded to the inlet of a conventional nitrogen-withdrawing column; causing the fraction of compressed, not cooled product to flow in the bottom of said argon-rectifying column and then forwarding it, in a partially cooled state for having transferred calories to the column, to said further cooling up to the liquefaction.

Another object of the present invention is a plant for producing argon by means of the separation from oxygen and nitrogen, characterized in that it comprises a rectification column having an inlet pipe connected to the middle zone of a rectification column of an air fractionation plant; said rectification column having the upper part connected to a heating, compressing and cooling circuit, which causes vapors evolved at the top of the column to be liquefied and recycled as refluxing liquid; the bottom of said column being heated by a fraction of said compressed and not yet cooled product, which is drawn from said circuit and recycled for subsequent liquefaction; the above mentioned circuit being connected downstream said cooling and liquefying zone to a conventional nitrogen-withdrawing column for supplying therein that portion of liquid product which was freed from oxygen and not used for the reflux.

The advantages can be attained by a process and an apparatus according to the present invention are evident in that the complex subsequent treatments for withdrawing oxygen from argon, i.e. the use of further auxiliary fractionation columns or of purifying agents for reaction with hydrogen, are no more necessary.

BRIEF DESCRIPTION OF THE DRAWING

Further objects, advantages and characteristics of the process according to the present invention will be evident to those skilled in the art from the following detailed description of an embodiment thereof, which is given as a non limiting example with reference to an annexed sole drawing representing a schematic view of a preferred apparatus designed to carry out said process.

DESCRIPTION OF THE PREFERRED EMBODIMENT

Referring to the FIGURE, there is represented a conventional distillation column 1 having superimposed plates therein or containing filling bodies, at the inlet of which through a pipe 2 gaseous product is fed which was drawn either from an appropriate zone, richer in argon, of the upper column of a conventional double rectification plant for producing oxygen and nitrogen from air or from a single rectification column of a plant. Such a gaseous product will substantially consist of gaseous oxygen, argon and nitrogen in a decreasing rate.

From the head of column 1 a pipeline is branching off which, when the apparatus is operating in a steady state, collects the high boiling vapours of the supplied mixture, i.e. the vapours of Ar and $N_2$, and forwards them to a circuit 30, through which the same are recycled once liquefied again to the top of column 1 to function as reflux liquid which is necessary for the correct operation of the rectification column 1.

The liquefaction is preferably carried out as follows: along line 3 a heat exchanger S1 is provided having two flow paths, in the first of which there flows argon (with nitrogen) coming from the headof column 1 and countercurrently to the same argon which is flowing downstream a compressor 31 interconnected in the circuit 30 into the second flow path of the same heat exchanger S1. After the compression the fluid is supplied to the heat exchanger S1 countercurrently to the same fluid upstream the compressor, causing thus the temperature of compressed argon to shift very near to the temperature of argon before the compression.

Not all of compressed argon is fed to heat exchanger S1 in order to be cooled, but a portion thereof is diverted through a circuit 40 in order to heat the lower zone of column 1 and then to be recycled into circuit 30 downstream the heat exchanger S1. Through an exchanger 41 there will take place a transfer of calories from the compressed argon to the surroundings in the base of column 1, thus promoting that temperature difference between the head zone and the base zone of the column which is necessary for the correct operation of the same. A liquid product rich in oxygen will collect in the lower zone of said column which can then be drawn through a pipe 4 and recycled again in the air fractionating column 100 near the outlet of pipe 2.

Obviously, the fraction of argon which has been diverted through circuit 40 and has transferred calories in the exchanger 41 will flow back in a cooler state into the circuit 30, as well as the portion cooled in exchanger S1 does. Successively, all the recycled argon is further cooled countercurrently in a heat exchanger S2 for instance by means of liquid nitrogen which is coming from the head zone of the rectification column in the air fractionation plant (not shown in the drawing). Since the liquefaction temperature of nitrogen is lower than the liquefaction temperature of argon, this latter liquefies and is again supplied, through a throttling element 32, to the top of column 1, thus acting as refluxing liquid for the operation of the same and for the enrichment of argon in the head zone. Not all of the liquid argon (with nitrogen) is recycled into the column 1, but a fraction thereof is supplied through a pipeline 5 downstream the exchanger S2 and upstream the throttling element 32 to the inlet of a conventional column 10 for the purification of argon from nitrogen.

As all of oxygen is withdrawn through pipe 4 and nitrogen as usual is streaming from the head zone of column 10, from the bottom of the latter one will obtain through a throttling element 11 pure argon or in any case argon sufficiently pure to be used without the need of further treatments.

What has been till now said with reference to the process according to the present invention and to the operation of the disclosed apparatus has been referred to a steady condition, whereby in the upper zone of column 1 a sufficient stream of gaseous argon is evolving mixed with nitrogen and the liquid product at the bottom of the column is substantially $O_2$. Such a condition is achieved during a variable starting period in which a progressive enrichment of argon in the upper part of column 1 takes place. In the case a reduction of this starting period is wanted, a stream of pure argon drawn outside the apparatus may be for instance used.

Possible additions and/or modifications may be made by those skilled in the art to the above described and illustrated embodiment of the method according to the present invention as well as of the relevant plant designed to put the same into practice, without sorting from the scope of the invention.

What is claimed is:

1. A method for producing argon by separation from oxygen and nitrogen from an air fractionation process, characterized in that it comprises the steps of:

a. forwarding to a rectifying column a gaseous argon, nitrogen and oxygen containing product coming out from an intermediate point of air fractionation column of said fractionation process;

b. heating a gaseous oxygen-free product containing a major amount of argon drawn from the head of said rectifying column;

c. compressing the oxygen-free product;

d. cooling a first fraction of the compressed product up to the liquefaction temperature of argon according to the compression pressure to form a liquefied product;

e. recycling a portion of the liquefied product to the top of said rectifying column through a throttling element to provide the reflux liquid for the rectifying column, the remaining portion of liquefied product being forwarded to the inlet of an argon column for withdrawing nitrogen;

f. causing a second fraction of compressed, gaseous oxygen-free product to flow to the bottom of said rectifying column for indirect reboil heat exchange, and g. recycling the second fraction in a partially cooled state, by having transferred calories to the rectification column, for further cooling up to the liquefaction temperature of argon.

2. The method of claim 1 wherein: a liquid product consisting essentially of oxygen is drawn from the base of said rectifying column, the liquid product being then forwarded to the inlet of said air fractionating column in a position near to the drawing point of said gaseous argon, nitrogen and oxygen-containing product.

3. The method of claim 1 which further comprises:

a. passing said first fraction of compressed product through a heat exchange countercurrently to the gaseous oxygen-free head product to heat said head product prior to cooling said first fraction, b. thereafter, reuniting the first fraction with the second fraction of compressed product after the second fraction has passed through the bottom of said rectifying column, and c. passing the reunited fractions through a heat exchange countercurrently to a refrigerating fluid, to cool the compressed product to the liquefaction temperature of argon prior to recycling to the top of the rectifying column.

4. The method of claim 3 wherein said refrigerating fluid for cooling the fractions to the liquefaction temperature of argon is liquid nitrogen coming from the top portion of said air fractionation column.

5. An apparatus for producing argon by the separation thereof from oxygen and nitrogen in a liquid air fractionation plant, characterized in that said apparatus comprises:

a. an air fractionation column, b. a rectifying column having an inlet pipe connected to a middle point of said fractionation column of said fractionation plant for issuing a gaseous nitrogen, oxygen and argon containing product into the bottom of said rectifying column;

c. a compressing and cooling circuit for the liquefaction of gaseous product coming out of the head zone of the rectifying column, the circuit including a throttling element for recycling the produced liquid into the head zone of the rectifying column;

d. means interconnecting the head zone of the rectifying column and the cooling and compressing circuit such that the gaseous product at the top of the head zone is delivered to the circuit;

e. a heat exchange disposed in the bottom of said rectifying column for transferring calories to the bottom zone of the rectifying column, the heat exchanger utilizing a fraction of the gaseous head zone product drawn through the circuit after the compression and before the cooling;

f. means for delivering the compressed fraction to the heat exchanger disposed in the bottom of the rectifying column;

g. a draining pipeline branching off from said bottom zone of said rectifying column, the pipeline draining the bottoms of the rectifying column, and h. a pipeline being interposed in said circuit between the cooling stage and the throttling element for supplying a fraction of the liquid product to the inlet of an argon-nitrogen separation column.

6. The apparatus of claim 5, wherein said draining pipeline connects the bottom of said rectifying column to the air fractionating column of said air fractionating plant in a position which is near to the outlet point of said inlet pipe.

7. The apparatus of claim 5 wherein said circuit comprises:

a. a compressor, b. a first countercurrent heat exchange in fluid communication with said compressor, c. a second countercurrent heat exchanger in fluid communication with the first countercurrent heat exchanger and the bottom zone heat exchanger, and wherein the compressed gaseous product passing through the first countercurrent heat exchanger passes countercurrent to gaseous product being delivered to the circuit to heat the gaseous product, the second countercurrent heat exchanger utilizes a refrigerating fluid having a temperature lower than that of the liquefaction temperature of argon, the refrigerating fluid passing countercurrently to the compressed gaseous heat exchanger and the compressed gaseous product exiting from the bottom zone heat exchanger.

8. The apparatus of claim 7, wherein said refrigerating fluid in said heat exchanger is liquid nitrogen drawn from said air fractionation plant.

* * * * *

UNITED STATES PATENT AND TRADEMARK OFFICE

CERTIFICATE OF CORRECTION

PATENT NO. : 4,057,407

DATED : November 8, 1977

INVENTOR(S) : Emanuele Bigi

It is certified that error appears in the above-identified patent and that said Letters Patent are hereby corrected as shown below:

In the Abstract, Line 2, delete the last word "the".

In Column 2, Line 61, delete the word "high" and insert therefor the word ----low----.

The Drawing Figure should appear as shown on the attached sheet.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*

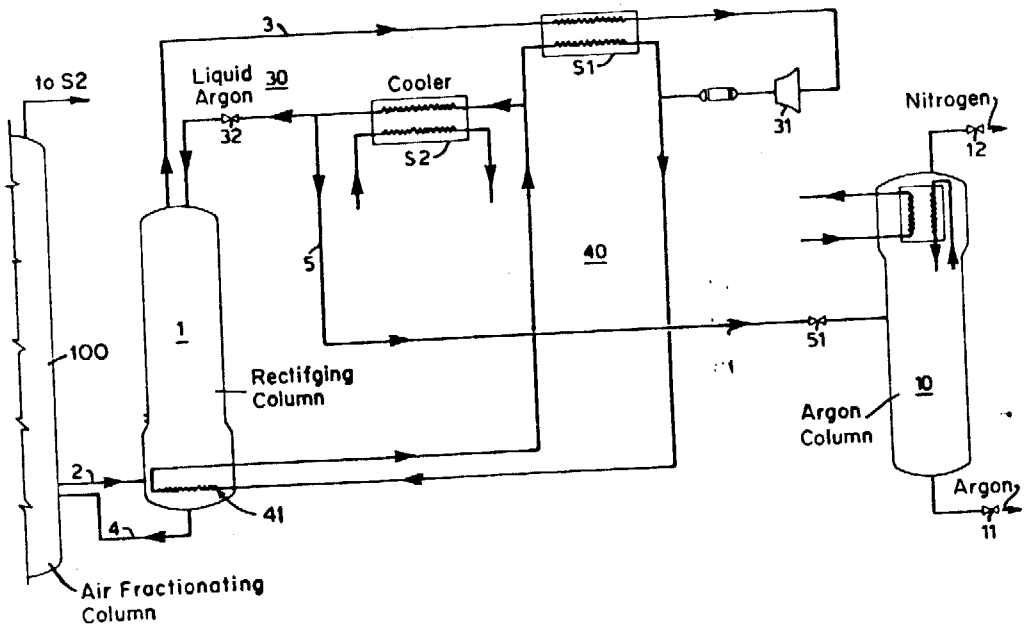
Nitrogen
12
Argon
11
10
Argon Column
51
31
S1
40
Cooler
S2
5
Rectifying Column
3
Liquid Argon 30
32
1
41
4
2
Air Fractionating Column
100
to S2